US006907744B2

(12) United States Patent
Miller et al.

(10) Patent No.: US 6,907,744 B2
(45) Date of Patent: Jun. 21, 2005

(54) ICE-MAKING MACHINE WITH IMPROVED WATER CURTAIN

(75) Inventors: Richard T. Miller, Manitowoc, WI (US); James S. MacIntyre, Wausau, WI (US); Lori S. Belongia, Manitowoc, WI (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 0 days.

(21) Appl. No.: 10/389,285

(22) Filed: Mar. 14, 2003

(65) Prior Publication Data

US 2004/0134219 A1 Jul. 15, 2004

Related U.S. Application Data

(60) Provisional application No. 60/365,435, filed on Mar. 18, 2002.

(51) Int. Cl.[7] ..... F25C 1/12
(52) U.S. Cl. ..... 62/74; 62/347
(58) Field of Search ..... 62/74, 347

(56) References Cited

U.S. PATENT DOCUMENTS 3,430,452 A * 3/1969 Dedricks et al. ..... 62/138
4,341,087 A * 7/1982 Van Steenburgh, Jr. ..... 62/233
4,366,679 A * 1/1983 Van Steenburgh, Jr. ..... 62/347
4,480,441 A 11/1984 Kohl et al.
4,489,567 A * 12/1984 Kohl ..... 62/138
4,727,729 A 3/1988 Toya
4,774,814 A 10/1988 Yingst et al.
4,986,088 A * 1/1991 Nelson ..... 62/347
5,031,417 A * 7/1991 Chang ..... 62/347
5,042,263 A * 8/1991 Day et al. ..... 62/74
5,586,439 A 12/1996 Schlosser et al.
5,924,301 A * 7/1999 Cook ..... 62/347
6,148,633 A * 11/2000 Yamada et al. ..... 62/347
6,705,090 B2 * 3/2004 Billman et al. ..... 62/74

FOREIGN PATENT DOCUMENTS

GB 2248491 A 4/1992

* cited by examiner

*Primary Examiner*—William E. Tapolcai
(74) *Attorney, Agent, or Firm*—Steven P. Shurtz; Brinks Hofer Gilson & Lione

(57) ABSTRACT

An ice-making machine has a substantially vertical ice-forming mold for freezing cubes of ice, a water distributor for distributing water so as to cascade over a front surface of said ice-forming mold and a hinged water curtain with a bottom edge for directing said cascading water into a sump, with the hinge allowing the water curtain to swing out of the way so that ice cubes harvested from the mold may fall past the sump and into an ice collecting bin. The water curtain has an inside surface adjacent to a front surface of the ice-forming mold configured such that as a slab of ice cubes is released from the mold during a harvest cycle, the front of the slab of ice contacts said inside surface and forces the water curtain to open to a point where the bottom of the falling slab of ice cubes will not contact the bottom edge of the water curtain. The water curtain may be further improved by molding one or more downwardly pointing chevrons or other structure on the inside of the water curtain, extending between the ribs so as to tie the ribs together to add rigidity to the water curtain.

37 Claims, 8 Drawing Sheets

ICE-MAKING MACHINE WITH IMPROVED WATER CURTAIN

REFERENCE TO EARLIER FILED APPLICATION

The present application claims the benefit of the filing date under 35 U.S.C. §119(e) of Provisional U.S. patent application Ser. No. 60/365,435, filed Mar. 18, 2002, which is hereby incorporated by reference in its entirety.

BACKGROUND OF THE INVENTION

The present invention relates to ice-making machines, and particularly to cube ice-making machines that have a vertical ice-forming mold and a water curtain to direct water cascading down the surface of the ice-forming mold back into a water sump.

Automatic ice-making machines have become widely used to make ice on the premises where it is used. The food service industry in particular uses such ice-making machines. For example, a restaurant needs ice to put in drinks served as part of a meal. In addition, ice is often used to cool food items. In a beverage dispenser, ice may be dispensed into a cup and may also be used to cool a cold pate that in turn cools beverage components that are dispensed and mixed in valves mounted on the dispenser.

The demand for ice at many eating establishments is hardly constant. Instead, demand peaks at meal times. Most ice-making machines are therefore mounted on ice collecting and storage bins. The ice machine can then run constantly and build up a reserve of ice. Often the reserve is built up over night, and ice machines are purchased by their size, based on the expected total daily demand for ice.

Cube ice makers and flake ice makers are both in common usage. However, cube ice is generally more desirable for cooling beverages. A common design for a cube ice-making machine includes a vertical ice-forming mold. The mold has dividers that create individual pockets. When the pockets are sufficiently filled with ice, the control system for the machine switches into a harvest cycle. The ice cubes are released from the mold. The dividers may be sloped downward toward the open front so that the ice cubes slide out of the ice-forming mold under the influence of gravity, and into the ice collection bin.

The ice-making machine also includes a sump located beneath the ice-forming mold, a water distributor above the ice-forming mold, and a pump to pump water from the sump up to the distributor. The water cascades down over the surface of the ice-forming mold. A part of the water freezes into the pockets and the rest runs off the surface of the ice-forming mold. A water curtain is placed adjacent to the ice-forming mold so that any splashing water is directed back into the sump. The bottom edge of the water curtain is bent to reach back under the ice-forming mold. This allows the front edge of the sump to be spaced behind the front of the ice-forming mold. With this design, the unfrozen water can return to the sump, but ice can fall straight down out of the ice-forming mold and into the collection bin.

The water curtain is typically suspended from pivots or hinges located near the top of the water curtain. The shape of the water curtain and location of the pivots are such that the center of gravity of the water curtain causes the sides of the water curtain to stay closed against the ice-forming mold frame while the machine is making ice. However, during the harvest cycle the water curtain can swing away as the ice is released from the ice-forming mold.

A thin bridge of ice forms over the dividers and between the individual cubes of ice. Most automatic ice-making machines allow for adjustment of the duration of the freeze cycle, which thus controls how thick this ice bridge becomes. A common control technique is to mount an ice thickness sensor so that as the ice bridge gets thicker, water running over the surface of it will contact a probe, directing the machine to automatically go into a harvest cycle. A thick ice bridge has the benefit that it helps in the harvest cycle, when water stops cascading over the front of the ice and the ice-forming mold is heated. A thick ice bridge allows the entire slab of interconnected ice cubes to be released at once. On the other hand, with a thin ice bridge, individual cubes have to each melt and drop out of their pockets, and adjoining cubes cannot help pull all of the ice out at once.

While thicker ice bridges have some benefits, there are also some drawbacks. Because ice is an insulator, the efficiency of the freezing operation decreases as the ice bridge builds, since the heat is commonly transferred out of the back of the ice-forming mold by serpentine refrigerant coils forming the evaporator section of a refrigeration system. Most importantly, many end users do not want thick ice bridges, because the slabs of ice cubes do not break into individual cubes as easily, and chunks of ice cubes frozen together are hard to dispense, scoop or fit into a cup.

One other common feature found in automatic ice-making machines is that they are designed to automatically shut down when the ice collecting bin is full. These automatic ice machines then operate around the clock, unattended. The result is hopefully a bin that is constantly full of ice, but not a machine that keeps making and harvesting ice when the bin is already full.

A common technique for shutting down the ice-making machines when the bin is full is to place a sensor, such as a magnetic reed switch, near the water curtain, and put a magnet on the water curtain. The reed switch can then determine whether the water curtain is closed. This reed switch has two uses. First, when the water curtain closes, the machine can automatically switch back into an ice-making mode from a harvesting mode. Second, if ice has built up in the bin such that the slab of ice being harvested does not fall all of the way past the bottom edge of the water curtain, the water curtain will remain open, and the reed switch will not close until ice no longer holds the water curtain open.

It is desirable that the compressor of the refrigerator system not stop and start every time ice is harvested. Therefore, it is typical to let the compressor continue to run unless the water curtain remains open for a set period of time. In prior art ice-making machines, this period of time was often set at 7 seconds. Normally, the water curtain would open and close in much shorter than 7 seconds during a typical harvest cycle. However, if the bin is full, the ice cannot fall out of the way and ice remains in the way of the water curtain to keep it from closing for more than 7 seconds. In this situation, the machine would sense a "bin-full" condition and shut down until the water curtain closed again, which could happen if the ice in the bin was removed or if it melted to the point that the pile of ice no longer supported the ice holding the water curtain open.

There have been instances when a false "bin-full" signal is generated and the ice machine shuts off even if the ice bin is not full. If it stays off for a prolonged period of time, it seriously reduces the amount of ice produced by the machine. Some end users have a high demand for ice, and when an ice machine shuts down without the bin being full, the user quickly calls and reports a malfunction. What may be worse, if the machine has shut down and no one notices it, such as over night, employees came in to work expecting to have a ready supply of ice and find the bin only partially full. By then, the machine may be running again, and the cause of the problem is therefore not discernible. However, in these instances, the end user again is not happy with the equipment. Therefore, there is a strong desire to prevent a false "bin-full" shutdown on the part of ice machine manufacturers.

Solutions to the problem have been tried in the lab, but when the solution was implemented in the field, the problem reoccurred. One piece of equipment that was prone to this problem was brought back from the field to be studied. It was determined that for some reason, cubes of ice were getting caught between the bottom edge of the water curtain and either the bottom of the ice-forming mold or the top edge of the water sump. This ice would hold the water curtain open until it melted sufficiently that it dislodged itself. Even with the ice machine being shut down, this might take several hours because the bin and ice machine are insulated and the ice in the bin keeps the temperature inside the ice-making compartment relatively cool. Of course, this situation did not occur on every harvest cycle, but it did happen frequently enough that it was a serious problem for the end user. Most ice-making machines of this same model were not being complained about. However, the number of complaints with respect to this model of machine, which had two evaporators and two ice-forming molds (a dual evaporator machine), was higher than with other models of machines.

Unfortunately, dual evaporator machines are often put into establishments where there is a high demand for ice because these machines can generally make twice as much ice per day as a comparably-sized single-evaporator machine. Thus, in the very place where it is least desirable to have a machine with a false "bin full" condition, machines most prone to this problem were being installed. Also, because both evaporators are on the same refrigeration system, if the problem occurred with either ice-forming mold, both evaporators quit freezing ice. As a result, there was an urgent need to find a solution to the problem, preferably one that could be used to retrofit ice machines already manufactured that exhibited this problem.

Another problem that has been encountered arises from the fact that most water curtains are fairly large pieces of plastic. They can be assembled by gluing smaller pieces together, but most economically they are made using vacuum forming or injection molding techniques. With such large sheets of plastic it is very difficult to get them perfectly flat once they have cooled after being molded. If the water curtain is not flat, one side may not be as close to the ice-forming mold as the other. This is known as "racking," and can let water spray come out of one side. Also, if the water curtain is racked, the slab of ice may hit one side of the water curtain first, causing a high load on the hinge pin on that side and premature failure of that hinge pin. Further, if the ice curtain is twisted too much, the side with the magnet used to operate the reed switch may be open even though the other side is closed, shutting down the machine; or it could be the other way around, with the side having the magnet being closed even though the other side of the water curtain is open because the ice bin is full on that side. Ice then continues to be made even though the bin is full on one side, and water going down the face of the ice-forming mold may fall into the bin rather than being directed by the bottom of the water curtain back into the sump, resulting in either water falling on and freezing the cubes of ice in the bin together, or wet ice in the bin. Also, for those machines that do not add water during the freeze cycle, and go into harvest when the water level drops to a predetermined point, the loss of water will result in less ice being made in each cycle.

BRIEF SUMMARY OF THE INVENTION

After investigation, it appeared that the ice slab on the dual evaporator machine seemed to release more quickly from the top of the ice-forming mold than from the bottom. Also, the problem seemed to occur mainly because the ice slab was not remaining intact as it fell into the ice bin. This seemed to happen either because the ice slab, which first hit against the bottom side of the water curtain as it fell, broke apart on this impact, or because the slab hitting the angled bottom side of the water curtain caused the water curtain to rapidly swing away. When it swung back, it would hit the slab of ice that was still falling and break the slab apart. Fragments of the broken slab would then get turned sideways and caught between the bottom of the water curtain and either the sump or some other portion of the ice machine. Especially in the dual evaporator machines, the space for the water curtain to swing open was quite limited, and often the curtain would strike an object inside the compartment and rebound into the falling slab of ice. Even in other machines where the ice slab comes out from the top and the bottom at the same time, it has been formed that the false "bin full" signal sometimes occurs because the slab is breaking apart before clearing the bottom of the water curtain. Again, this could be due to the slab hitting the bottom side of the curtain as it falls, either breaking the slab or causing the curtain to rapidly swing away and rebound back into the falling slab.

Many different solutions were suggested, many of which were not very practical, or were expensive, or could not be used in a retrofit situation. One suggestion was to add two rounded sections to the intersection between the inside surface and bottom side of the water curtain, in an effort to make the slab's contact with the water curtain less violent. While this made some improvement, there was another improvement that was found to reduce the problem of false bin full shutdown as to be nearly non-existent. It was found that by configuring the inside surface of the water curtain so that the ice slab contacted the curtain and pushed it open from near the top, or at least near a mid-portion of the water curtain, the bottom edge of the water curtain could be moved completely out of the way before the ice slab fell, so that the bottom of the slab did not contact the bottom edge of the water curtain. In its most preferred form, this was done by adding two ribs of the correct shape and dimensions to the inside surface of the water curtain.

Further, it has been discovered that by adding other structural elements on the face of the water curtain between the ribs that tie into the side walls of the ribs, the rigidity of the water curtain was greatly improved. This prevents the water curtain from racking. The increased rigidity helps the water curtain to remain square to the ice forming mold, preventing splash out on one side, and the problem of the reed switch being closed even when the ice bin is full on one side, thus reducing the problems caused by racking. Further, with the increased rigidity, even if the falling ice strikes one side of the water curtain first, the load is more uniformly carried between the hinge pins.

Thus, in a first aspect, the invention is an improved ice-making machine having a substantially vertical ice-forming mold for freezing cubes of ice, a water distributor for distributing water so as to cascade over a front surface of the ice-forming mold and a hinged water curtain with a bottom edge for directing the cascading water into a sump, with the hinge allowing the water curtain to swing out of the way so that a slab of ice cubes harvested from the mold may fall past the sump and into an ice collecting bin. The improvement comes from providing the water curtain with an inside surface (adjacent to a front surface of the ice-forming mold) configured such that as the slab of ice cubes is released from the mold during a harvest cycle, ice in the slab contacts the inside surface and gently forces the water curtain to open to a point where the bottom of the falling slab of ice cubes will not contact the bottom edge of the water curtain.

In a second aspect, the invention is a water curtain for an ice-making machine comprising one or more ribs formed on the water curtain so as to contact a slab of ice as it is released from an ice-forming mold, the ribs having a sufficient height so that when the water curtain is in place on an ice-making machine, the slab of ice will contact the ribs to force the water curtain out away from the ice-forming mold so that the bottom edge of the water curtain is not underneath the slab of ice.

In a third aspect, the invention is an ice-making machine comprising: a) a water system including a pump, a sump, a substantially vertical ice-forming mold having a back surface and an open front surface to form a slab of ice, a distributor for distributing water pumped from the sump over the front surface of the ice-forming mold, and a water line interconnecting the pump and the distributor; b) a refrigeration system comprising a compressor, a condenser, an expansion device, an evaporator with refrigerant channels formed in a serpentine shape in thermal contact with the back surface of the ice-forming mold, and interconnecting lines therefore; and c) a water curtain having a bottom edge, the water curtain being positioned adjacent the front surface of the ice-forming mold so as to direct water cascading over the open front surface of the ice-forming mold into the sump, the water curtain being hinged so as to swing away from the ice-forming mold during harvest of an ice slab from the ice-forming mold, the water curtain having an inside surface configured so as to contact the slab of ice as it is released from the mold, the position of the hinge and the configuration of the inside surface cooperating so as to cause the bottom edge of the water curtain to gently swing out to a point where the bottom of the slab of ice can pass between the sump and the bottom edge of the water curtain without striking the bottom edge of the water curtain as it falls.

In a fourth aspect, the invention is a method of producing and harvesting ice from a cube ice-making machine into an ice collecting bin so as to reduce the chance that the ice-making machine will shut down before the ice bin is full, comprising the steps of: a) forming cubes of ice from water cascading down over a substantially vertical ice-forming mold having a back surface, an open front surface and lateral and vertical dividers that form individual pockets in which individual cubes are frozen, with an ice bridge formed between cubes of ice and over the dividers on the open front surface of the ice-forming mold to constitute a slab of ice cubes, with water not being frozen being directed into a water sump by a bottom edge of a water curtain, the water curtain being adjacent the open front surface of the ice-forming mold; b) halting the flow of water and heating the ice-forming mold in a harvest cycle to release the slab of frozen ice cubes, and c) using the upper portion of the slab of cubes to contact ribs on the inside surface of the water curtain to push the bottom edge of the water curtain away from the water sump enough so that the slab of ice released can fall past the bottom edge of the water curtain without the bottom of the slab contacting the bottom side of the water curtain.

In a fifth aspect, the invention is an improved water curtain for an ice-making machine that can be mounted so as to have an inside surface that catches splashes of water flowing over an ice forming mold and directs the water into a sump, the improvement comprising a pair of generally vertical ribs on the inside surface of the water curtain and an additional structure also on the inside surface extending between and tying the ribs together.

The ribs that were added to the inside surface of the water curtain preferably start at a point midway down in the top half of the water curtain and have a downwardly inclined top surface, with a generous radius connecting this top surface to the remainder of the rib. Because the curtain is held open from the top, the ice slab, even with a fairly thin ice bridge, can drop into the ice bin without interference and being broken by the water curtain. The control system of the ice-making machine is also preferably modified to increase the set period of how long the water curtain may be open before the machine shuts down, because with the ribs the water curtain begins to open as the ice first starts to release, and frequently the ice curtain is open for longer than 7 seconds during a normal harvest cycle. Downwardly pointing chevrons or other structure molded into the inside surface of the water curtain and extending between the ribs ties the ribs together and adds rigidity to the water curtain to prevent racking.

BRIEF DESCRIPTION OF THE DRAWINGS

These benefits of the invention, and the invention itself, will be best understood in view of the attached drawings, in which.

DETAILED DESCRIPTION OF THE DRAWINGS AND PREFERRED EMBODIMENTS OF THE INVENTION

Figure 1:
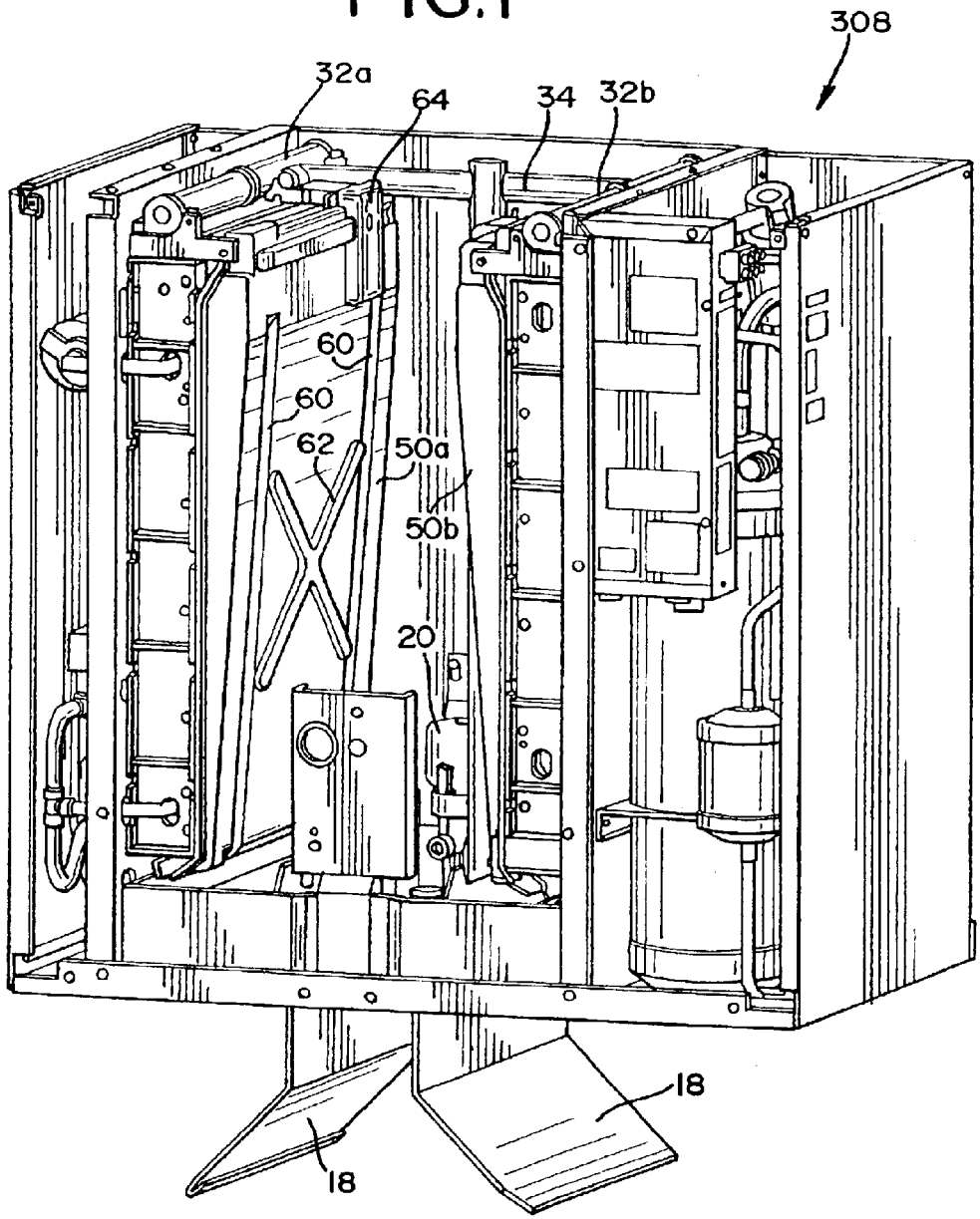
FIG. 1 is a perspective view of a preferred ice-making machine in accordance with the present invention, with its front face and top panel removed.

While the present invention was developed initially for a dual evaporator ice-making machine, it has application on other ice-making machines having substantially vertical ice-forming molds. Especially as such machines are made more compactly, the distance that the water curtain has to swing out of the way in a harvest mode will become more limited. The preferred embodiment of the invention as discussed herein is applied to a dual evaporator cube ice-making machine based on the Model QYDUAL4C ice-making machine sold by Manitowoc Ice, Inc. of Manitowoc, Wis. Since many of the aspects of that machine are not changed in making the present invention, they are not discussed further herein. Suffice it to say, the Model QYDUAL4C ice-making machine uses cool vapor defrost technology, disclosed in U.S. Pat. No. 6,196,007, incorporated herein by reference. The ice-making machine has a refrigeration system 300 shown in FIG. 10. The system is housed in two separate units, a condensing unit 306 and an ice-making unit 308, usually separated by a roof 304 of a building. The refrigeration system 300 includes a compressor 312, a condenser 314, an expansion device 326 and an evaporator 328. In the dual evaporator machine shown, there are two expansion devices, 326*a* and 326*b*, and two evaporators, 328*a* and 328*b*. The evaporators each have refrigerant channels in the form of tubing 26 (FIG. 9) formed in a serpentine shape in thermal contact with the back surface of the ice-forming mold, and interconnecting lines.

In the preferred embodiment, the condensing unit 306 also includes refrigerant line 313 between the compressor 312 and the condenser 314, another refrigerant line 315 correcting a head pressure control valve 316 to the condenser 314, and a bypass line 317 between the head pressure control valve 316 and the compressor 312. The preferred condensing unit 306 also includes an accumulator 332 including a J-tube 335, a fan cycling control 352, a high pressure cut out control 354 and a low pressure cut out control 356.

In the ice making unit 308, two thermal expansion valves 326*a* and 326*b* are used, feeding liquid refrigerant through lines 323*a* and 323*b* to evaporators 328*a* and 328*b*, respectively. Each is equipped with its own capillary tube and sensing bulb 329*a* and 329*b*. Likewise, two solenoid valves 336*a* and 336*b* are used to control the flow of cool vapor to evaporators 328*a* and 328*b* through lines 333*a* and 333*b*. This allows the two evaporators to each operate at maximum efficiency, and freeze ice at their own independent rate. Of course it is possible to use one thermal expansion valve, but then, because it would be very difficult to balance the demand for refrigerant in each evaporator, one evaporator (the lagging evaporator) would not be full when it was time to harvest the other evaporator.

Having two separate solenoid valves 336*a* and 336*b* allows one valve to be closed once ice has been harvested from the associated evaporator. When it is time to harvest, solenoid valves 336*a* and 336*b* will open, and cool vapor from receiver 318 will be permitted to flow into lines 333*a* and 333*b* and into evaporators 328*a* and 328*b*. Both evaporators go into harvest at the same time. However, once ice falls from evaporator 328*a*, the valve 336*a* will shut, and evaporator 328*a* will be idle while evaporator 328*b* finishes harvesting. With valve 336*a* shut, cool vapor is not wasted in further heating evaporator 328*a*, but rather is all used to defrost evaporator 328*b*. Of course, the reverse is also true if evaporator 328*b* harvests first.

The preferred ice making unit also includes a check valve 358 on liquid line 319 into receiver 318. The receiver includes inlet 320, liquid outlet 322 and vapor outlet 334. A hand shut off valve 360 may be included, along with drier 324, liquid line solenoid valve 362 and refrigerant lines 321, 325 and 331.

Figure 9:
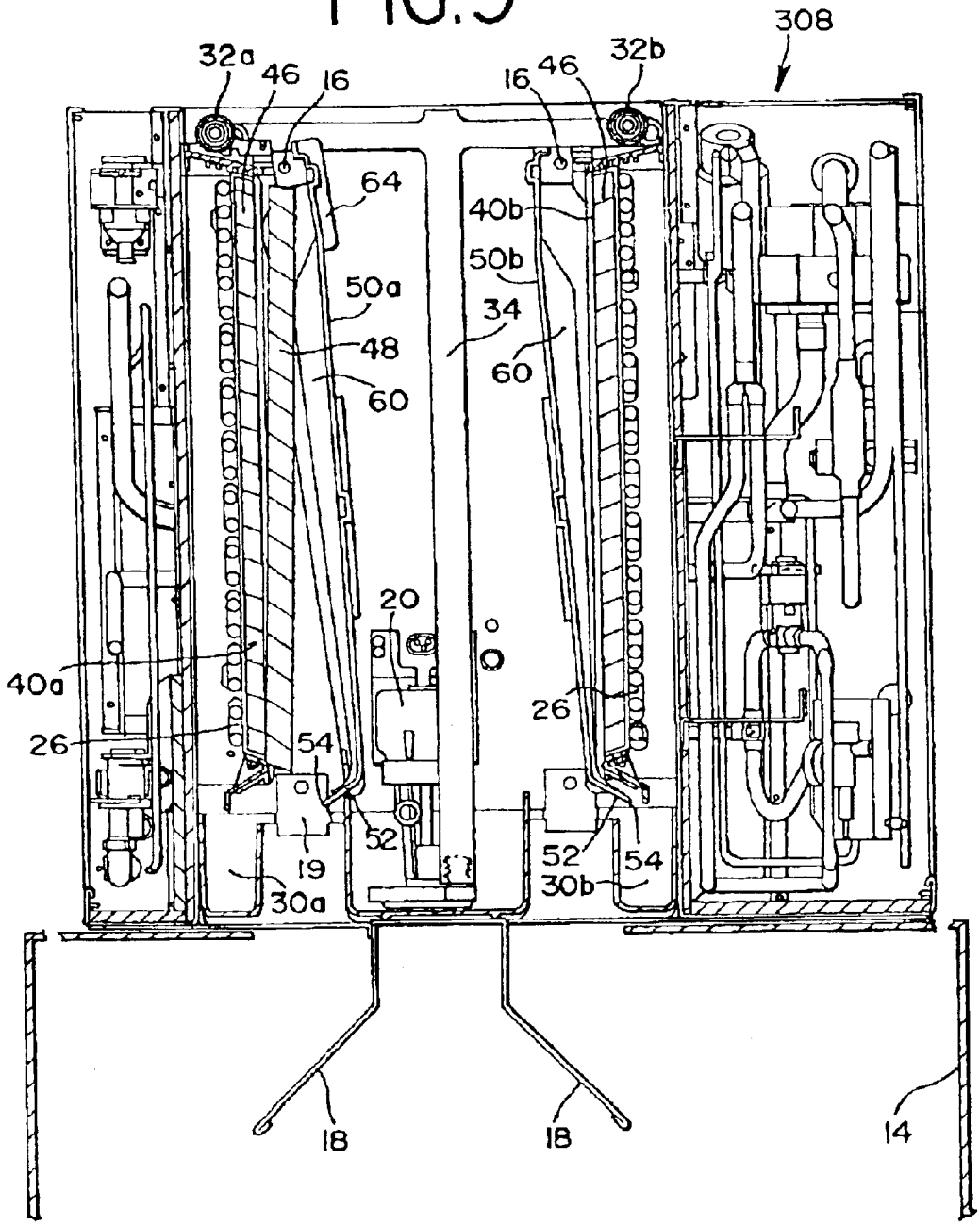
FIG. 9 is a cross-sectional view of the ice-making machine of FIG. 1 showing a slab of ice being harvested, with the ice machine sitting on an ice collecting bin.
Figure 10:
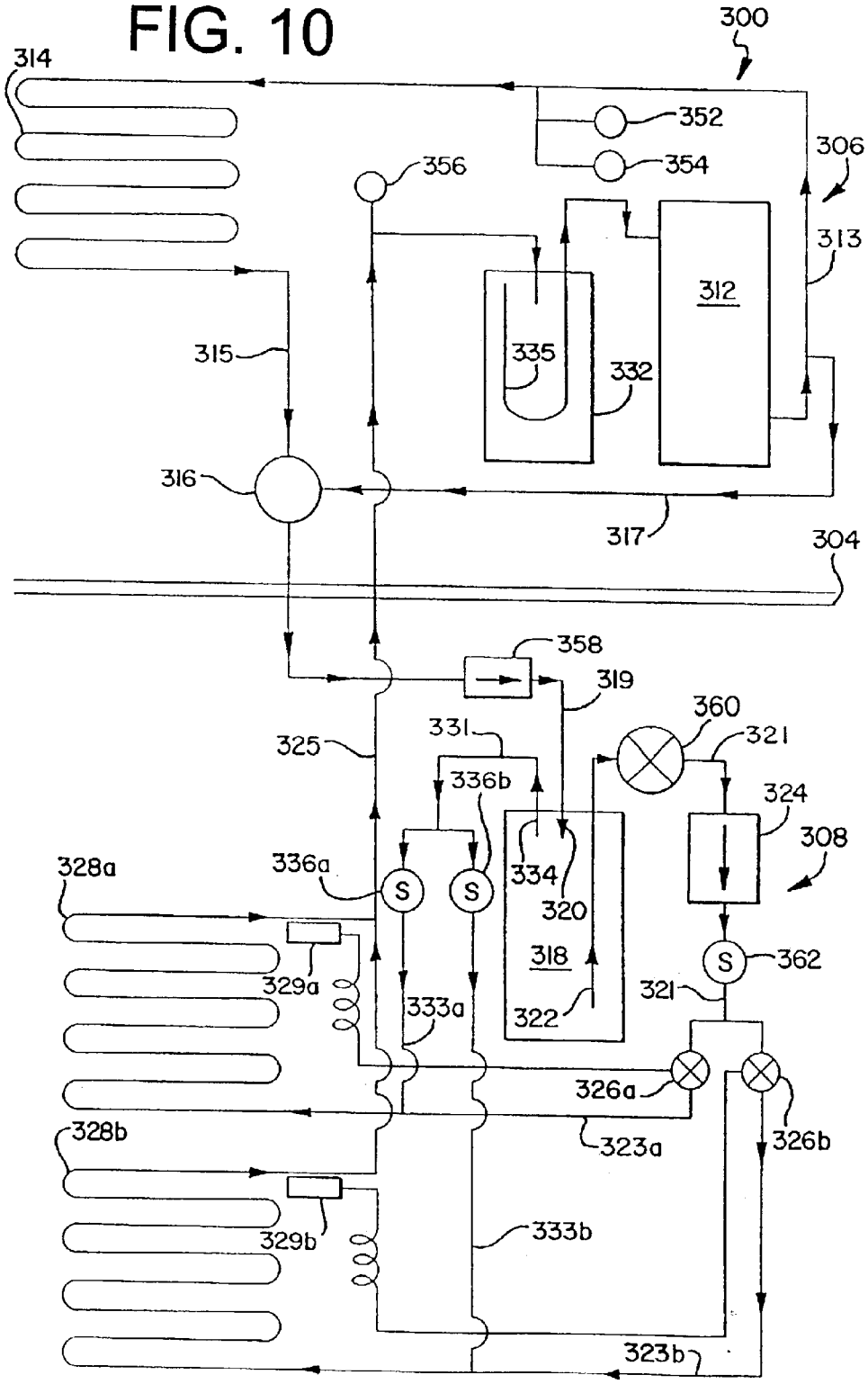
FIG. 10 is a schematic diagram of the refrigeration system used with the ice-making machine of FIG. 1.

The ice making unit 308 also houses the water system of the ice-making machine. As shown in FIGS. 1 and 9, this includes a pump 20, and two (labeled a and b) of each of the following: a sump 30, a distributor 32, and an ice-forming mold 40. A water line 34 interconnects the pump 20 with each of the distributors 32*a* and 32*b*. The distributors 32 distribute water pumped from the sump over the front surfaces of the ice-forming molds 40*a* and 40*b*.

The ice-forming molds 40 are substantially vertical in their preferred orientation. The preferred molds are made from copper pans with a flat back surface and an open front surface. The tubing coils 26 of the refrigeration system are soldered to the back surface, as seen in FIG. 9. The molds 40 also preferably contain lateral and vertical dividers that form individual pockets (not shown). The lateral dividers 46 are preferably sloped downwardly so that the slab of ice slides out of the pockets under the influence of gravity.

The water curtains 50*a* and 50*b* are shown closed in FIG. 1 and on the right half of FIG. 9. In this position each water curtain 50 directs water cascading over the open front face of the ice-forming molds into its respective sump 30. As shown in FIGS. 5–8, the water curtain 50 includes side portions 56 with side edges 58 that are designed to contact the frame on the sides of the ice-forming mold 40. These keep the water from splashing out the sides. The water curtain 50 has a bottom side 52 that bends back under the ice-forming mold and terminates in an edge 54 that extends under the ice-forming mold and directs the cascading water into the sump 30. The bottom side 52 is sloped downwardly.

Figure 8:
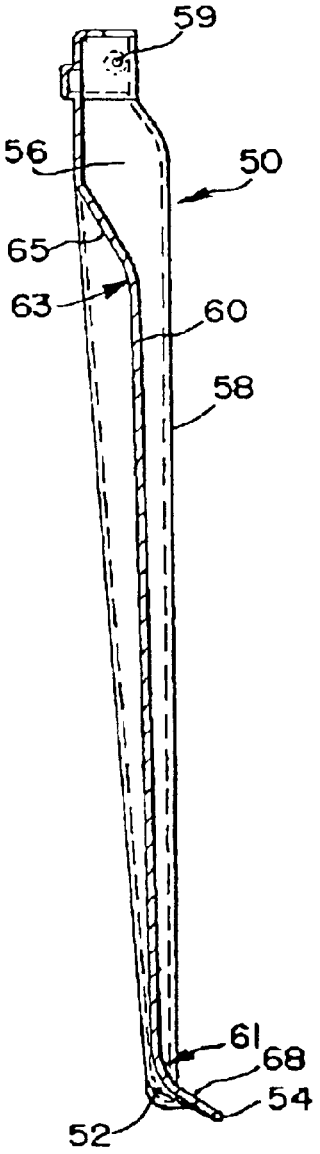
FIG. 8 is a cross-sectional view taken along line 8—8 of FIG. 5.

The water curtain 50*a* is shown open in the left half of FIG. 9, with a slab of ice cubes 48 being harvested and opening the water curtain according to the present invention. This is possible because the water curtains 50 are hinged to swing about an axis near the top of the water curtain. This is preferably accomplished by molding a hole in the top of each of the sides 56 of the water curtains and mounting a pin 59 in the holes (FIG. 8). These pins 59 fit into holes 16 (FIG. 9) in tabs extending from the frame surrounding the ice-forming molds 40. This hinge arrangement allows the water curtain 50 to swing away from the ice-forming mold 40 during the harvest cycle so that the ice cubes harvested from the mold may fall past the sump 30 and into ice collecting bin 14 through openings in the bottom of the ice making unit and the top of the ice collecting bin 14.

What has been described so far is also applicable to the water curtain 70 (FIGS. 2 and 3) as originally designed for and used on the Model QYDUAL4C ice making machine, as well as on other water curtains used for many years on other ice making machines, such as the water curtain 80 (FIG. 4) used on the Model QY1304A Manitowoc ice making machine. These prior art water curtains 70 and 80 also had a figure X design 72 molded into the plastic making up the main surface of the water curtain, to add rigidity and strength, as is well known in the art of plastic molding. However, other than the figure X design 72, the inside surface of the water curtain 70 was generally flat. Up at its top, the water curtain 70 was molded with a section 74 permitting room for the ice thickness sensor that sits at the top of the ice-forming mold. This sensor includes a probe that is contacted by the water when the ice cubes freezing in the pockets and the bridge between cubes and over the dividers has grown to the desired thickness.

Figure 3:
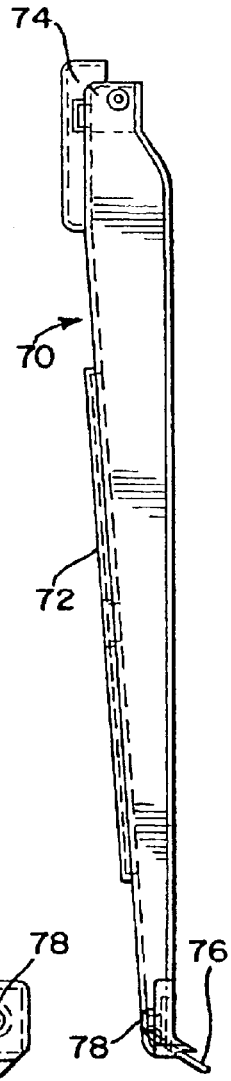
FIG.3 (PRIOR ART)
FIG. 3 is a side elevational view of the water curtain of FIG. 2.
Figure 7:
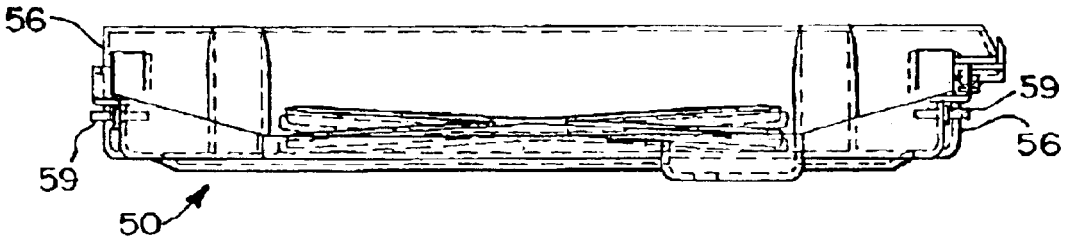
FIG. 7 is a top plan view of the water curtain of FIG. 5.

As can be imagined from looking at FIG. 3, when the slab of ice was harvested, it would slide out of the ice-forming mold and fall down until it hit the bottom side 76 of the water curtain 70. This bottom side 76 was sloped. As the ice slab hit the bottom, the impact would force the water curtain to swing outwardly. As noted above, however, unfortunately many times the force of the impact would also cause the ice slab to break up. The slab of ice was designed to be broken up as it entered the ice bin as it would strike deflectors 18 (FIGS. 1 and 9) suspended from the bottom of the ice making unit in the upper portion of the ice collecting bin 14.

Figure 2:
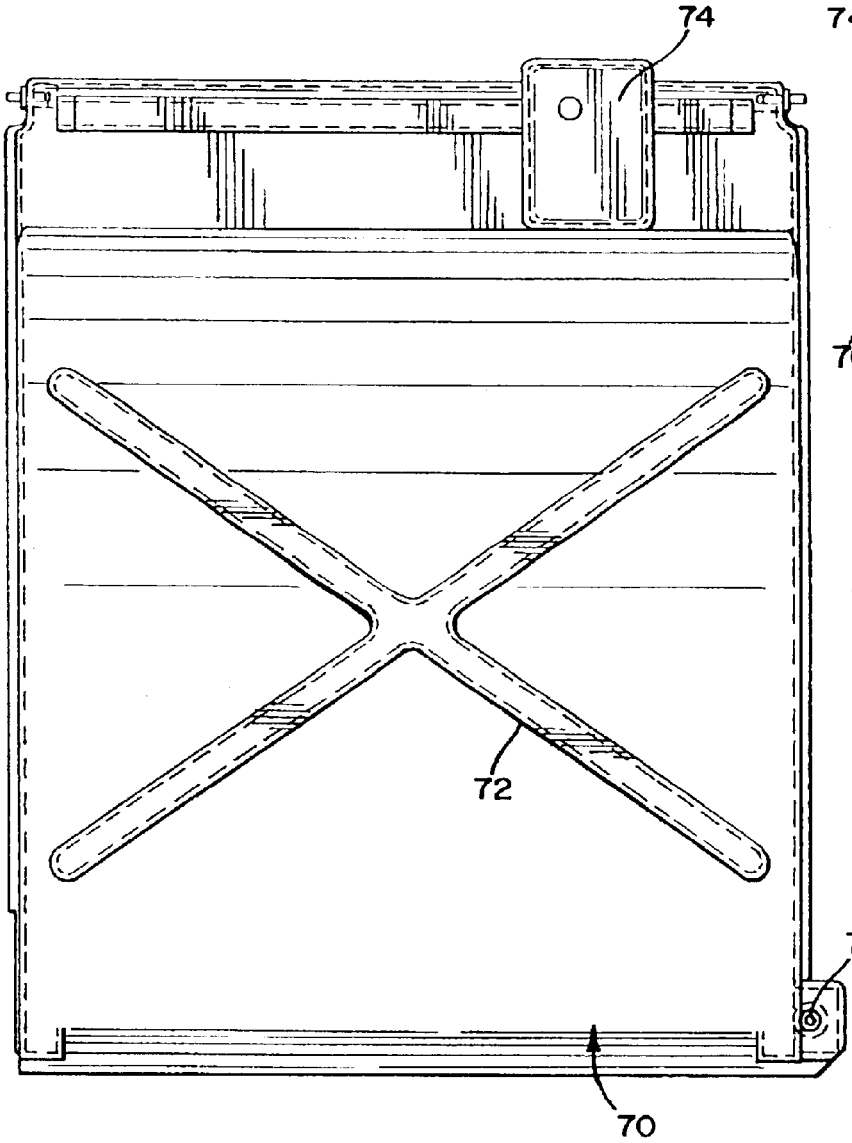
FIG.2 (PRIOR ART)
FIG. 2 is a front elevational view of the water curtain as it was designed prior to the modification of the present invention.

Also shown in FIGS. 2 and 3 is the magnet 78 that is used to detect when the water curtain is open. A similar magnet 88 (FIGS. 5 and 6) is found on the improved water curtain 50, to perform the same function.

The main difference between the prior art water curtain 70 and the improved water curtain 50 is the addition of two ribs 60 on the inside surface of the improved water curtain 50. The profile for these ribs is best seen in FIG. 8. The figure X design 62 is also reduced in size to fit between the ribs 60. The section 64 is still provided at the top to give clearance for the ice thickness sensor.

With the addition of the ribs 60, the inside surface of the water curtain 50 is configured such that as a slab of ice cubes 48 is released from the ice-forming mold 40 during a harvest cycle, ice in the slab contacts the inside surface and forces the water curtain to open to a point (FIG. 9, left side) where the bottom edge 54 of the water curtain will not contact the bottom of the falling slab of ice cubes 48. The position of the pin 59 forming the hinge axis and the configuration of the inside surface cooperate to cause the water curtain to open so that the bottom edge of the water curtain is out of the way and the slab of ice can pass between the sump 30 and the bottom edge 54 of the water curtain 50.

While two ribs 60 are depicted, the number of ribs may be varied, and the size may be varied as well, so long as they provide the inside surface of the water curtain with sufficient points of contact. If one rib were used, it would preferably be placed in the center of the water curtain 50. The benefit of using two ribs 60 is that they can be spaced toward the outer sides portion 56 of the water curtain and provide spaced points of contact. Although narrower ribs will work, it is preferable that the ribs are each wider than individual cubes of ice. Typically, the ice cubes will be ⅜, ⅞ or 1⅛ inches (1.0, 2.2 or 2.9 cm) wide, depending on the ice-forming mold used and the spacing between the vertical dividers. The preferred arrangement is two ribs 60 each 1¼ inches (3.2 cm) wide. This will allow the ribs to contact at least one, and usually two or three of the ice bridges over the vertical dividers.

As shown in FIG. 9, the ribs 60 extend up to a height below the height of the top of the ice-forming mold. Also, the ribs 60 have a top portion 65 (FIG. 8) that is tapered downwardly and outwardly from the inside surface of the water curtain 50. The remainder of the rib 60 is preferably generally parallel to the edge 58 of the water curtain designed to contact frame of the ice-forming mold. In this fashion the rib is also generally parallel (over most of its length) to the front face of the ice-forming mold, as seen on the right side in FIG. 9.

The distance that the rib 60 extends toward the ice-forming mold 40 is important, as this determines whether the water curtain will open sufficiently far. This distance is a function of a number of factors, such as the depth of the ice-forming mold, the thickness of the ice bridge, the position of the hinge axis, and the length that the bottom edge 54 extends back into the sump area. In the preferred embodiment, at its greatest height the rib extends to within about 5/16 to 11/32 inch (0.8 to 0.9 cm) of the slab when the slab is frozen sufficiently thick to be harvested. Preferably the rib will extend at least 1⅛ inches (2.9 cm) from the inside surface of the water curtain at this point, and more preferably about 1 3/16 inches (3.0 cm).

It is preferred that the top section 65 joins the rest of the rib 60 with a rounded profile 63 having a radius of at least one inch (2.5 cm), and more preferably at least 2⅜ inches (6.0 cm). Since this is the point where the slab of ice first contacts the ribs 60, a generous radius prevents the slab from getting hung up at this juncture. It is preferred that this tangent point, where the rib 60 contacts the ice slab, be at least 3 inches (7.6 cm) from the axis of the pins 59, and more preferably about 5 inches (12.7 cm). At this distance there is a sufficient torque arm to force the water curtain open. However, it is believed that if the point of contact is below the top half of the slab for the fairly tall evaporator in the Model QYDUAL4C ice-making machine, and possibly even below the top third of the slab, the slab may be prone to break apart on contact with the ribs.

In the preferred water curtain 50, the distance from the pivot axis of the pins 59 to the point of contact of the ice slab is about 5 inches (12.7 cm). The distance from the pivot axis to the bottom edge is about 23 inches (58.4 cm). Thus the distance that the slab moves the rib will be multiplied by a factor of 23÷5 in determining the distance that the bottom edge 54 is moved. In the preferred ice-making machine the pockets have a dept of about ⅞ inch (2.2 cm), and the ice bridge is about ⅛ inch (0.3 cm) thick. Thus the ice slab will have a thickness of about 1 inch (2.5 cm). When the ice slab has moved out about 5/16 of an inch (0.8 cm), it will contact the ribs 60. As the ice slab moves out the remaining 9/16 inch (⅞–5/16) (1.4 cm (2.2–0.8)), before the ice slab is released, the bottom edge 54 will be moved just over 2.5 inches (6.4 cm). This allows the bottom edge 54 to clear the drop zone before the ice slab is released.

At the bottom of the ribs 60, the bottom side 52 of the water curtain is preferably formed with rib extensions 68 as shown in FIG. 8. These rib extensions 68 form a smooth transition with a radius 61 of about 1¼ inches (3.2 cm) with the rib 60.

Figure 4:
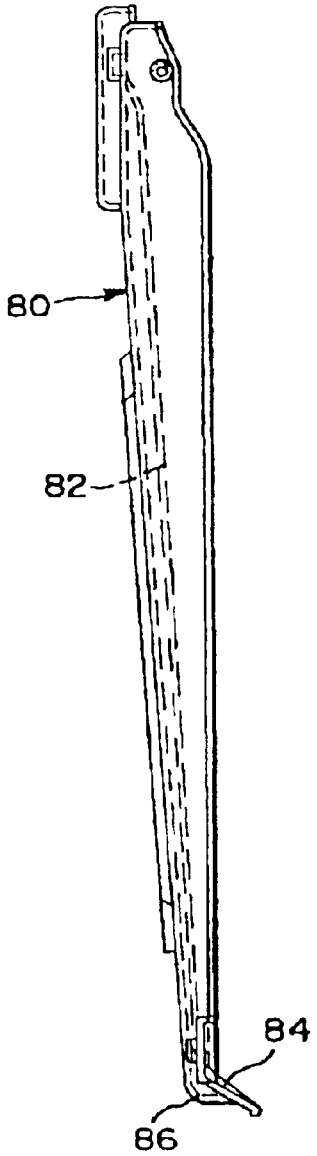
FIG.4 (PRIOR ART)
FIG. 4 is a side elevational view of a water curtain used on a different prior art ice-making machine.

A prior art water curtain 80 (FIG. 4) was produced with ribs 82 and rib extensions 84. The rib extension 84 were initially placed on the water curtain 80 to provide a more gentle slope in the area where the ice slab contacted the bottom side of the water curtain 80. In this model of ice machine, the slab of ice is rather large, and the striking of slab on the bottom side of the water curtain was quite violent. The rib extension helped to give a more gentle opening of the water curtain. In this water curtain, rather shallow ribs 82 were used just to provide rails that would contact the top of the slab as it fell down. As seen in FIG. 4, these ribs 82 did not extend far enough to contact the ice slab until after it was already released from the mold. The ribs 82 did not contact the slab and force the curtain open, but rather guided the slab as it fell after the curtain was opened by the slab contacting the bottom side 86 of the water curtain 80. As noted above, when this design of a water curtain was initially tried as a fix to the QYDUAL4C machine having a frequent false "bin full" condition, the prior art design did not sufficiently correct the problem. It is somewhat of a coincidence that a solution to the problem was embodied in the preferred ribs 60, yet the shallow ribs 82 were found on prior art water curtains.

The control system of the present invention may be modified to make the set period longer before the machine shuts down to take into account how long the water curtain is normally open. A set point of 10 seconds or greater is preferred, and a set point of 20 seconds or greater is more preferred. In a most preferred embodiment, the set point may be about 30 seconds. Of course, in a retrofit situation, it would be best if the original 7 second set point could continue to be used. This may be possible on some models of ice machines, or with further refinement of the rib design and other water curtain dimensions.

The retainer clip 19 that supports the back of the sump trough can be seen in FIG. 9. Even though it appears that this is directly under the slab of ice 48, it is actually set back into the machine at a depth that it does not interfere with the falling ice. However, it includes a defector to help keep any ice cubes from falling on and damaging the edge of the water sump.

While sloped horizontal dividers are preferred, it is also possible to use other means to help release the ice from the ice-forming mold. For example, a mechanical pusher could be used, or a pressurized fluid could be introduced between the back of the ice cubes and the pockets in which they are formed, as disclosed in the U.S. patent application Ser. No. 10/236,488, filed Sep. 6, 2002, which is hereby incorporated herein in its entirety.

While the preferred embodiment uses ribs 60, there are other ways that the inside surface of the water curtain 50 could be modified so that the face of the ice slab contacts the water curtain to make it open before the ice is fully released from the ice forming mold. It is contemplated that bumps instead of ribs could be placed on the surface. A horizontal rib or series of horizontal ribs may be utilized. The entire surface could be modified to bring it closer to the frozen ice, rather than just adding one or more ribs.

The preferred embodiment of the present invention has the benefit that the ribs actually act to hold the top of the ice slab from falling out as far as it might otherwise do if the ribs were not present. This keeps the ice cubes from getting wedged into the pockets and thus having to be melted more to be released. Also, because the water curtain is started to be pushed open gradually as the ice starts to be released, it is not opened an excessive distance, and therefore does not rebound or swing shut causing the bottom edge 54 to hit into the slab 48 with enough force to break the slab. Thus, even if the ribs 60 are not large enough to hold the curtain open until the ice slab is all the way past the bottom edge 54, there is not as much of a potential for the ice slab 48 to get broken up, and a portion of the slab getting wedged in between the bottom edge 54 and the sump 30, causing a false bin-full condition.

Figure 11:
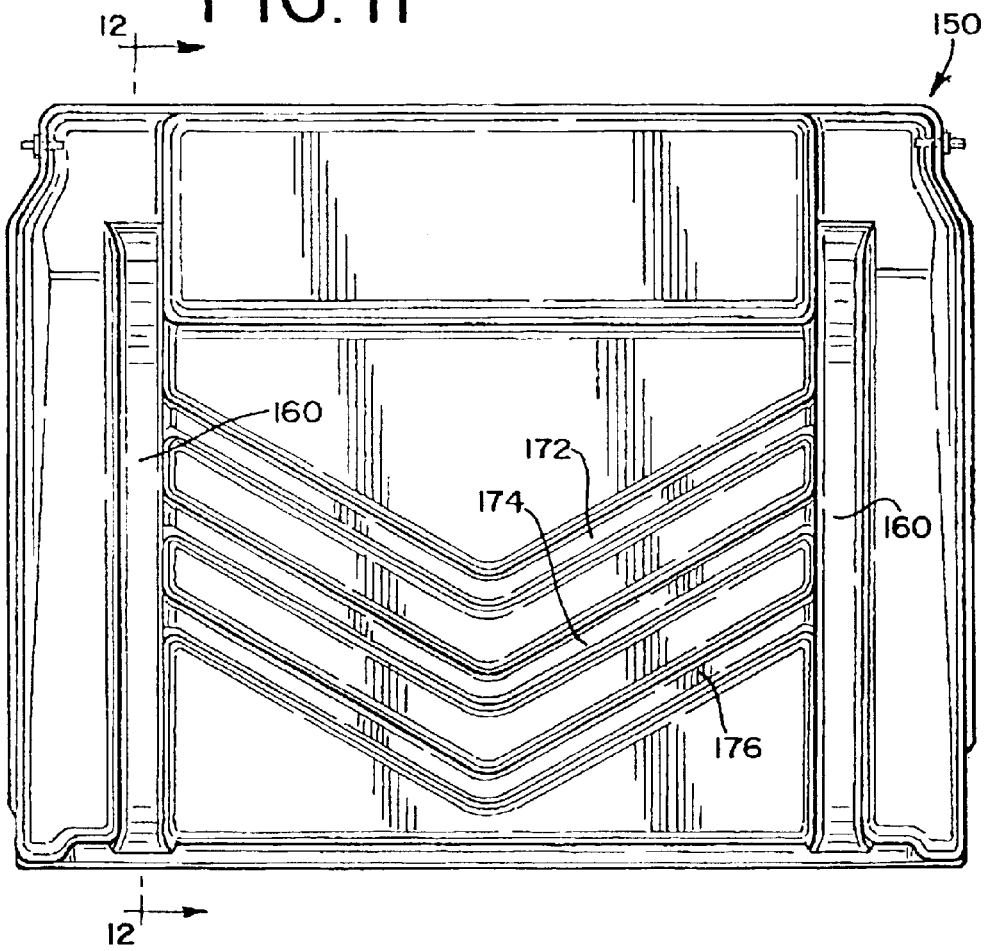
FIG. 11 is a front elevational view of a second preferred water curtain of the present invention.
Figure 12:
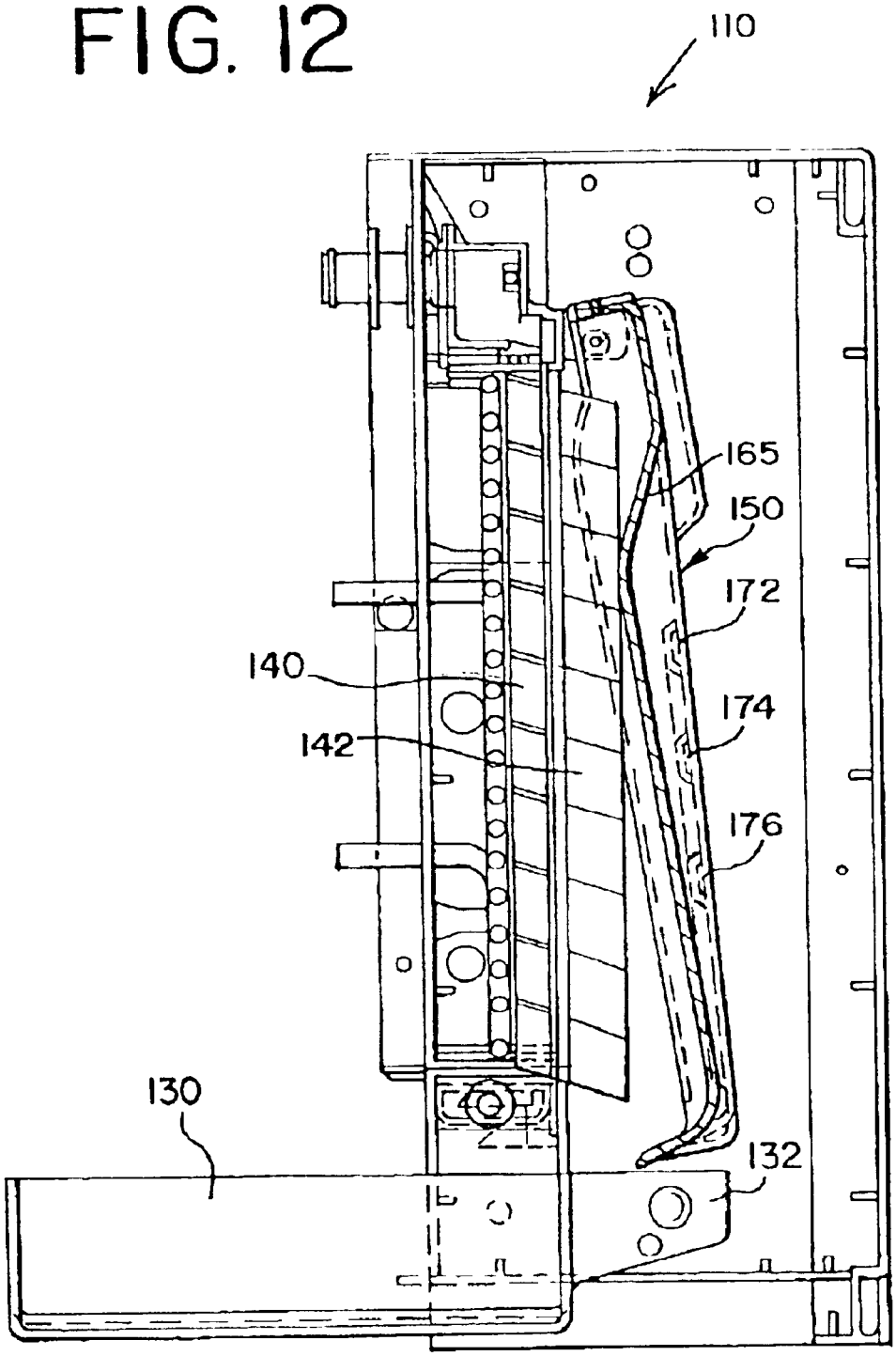
FIG. 12 is a cross-sectional view of a second ice making machine showing a slab of ice being harvested and a cross-sectional view of the water curtain taken along line 12—12 of FIG. 11.

Another embodiment of an improved water curtain 150 is shown in FIG. 11. The water curtain 150 is shown mounted in an ice making machine 110 in FIG. 12. Just as in the ice making unit 308, the ice machine 110 includes an ice forming mold 140 and a sump 130. The sump 130 is secured to the rest of the machine 110 with mounting tabs 132 on both sides of the machine, though only one of the mounting tabs 132 is seen in FIG. 12. It will thus be understood that tabs 132 are to the side of the ice-forming mold 140 and thus do not interfere with the ice falling from the mold during harvest.

The water curtain 150 is designed for ice-making machine 110 which does not have as tall of an ice-forming mold as that shown in FIG. 9. In this shorter machine, it has been found that the slab of ice cubes 142 releases more uniformally top-to-bottom than did slab 48, which tended to tip out from the top. Also, it was discovered that if the ribs 160 extended too far inwardly from the inside surface of the water curtain, and were placed too high, the ice slab could contact the ribs before the slab was free of the ice pockets, but without a sufficient torque to enable the water curtain to swing open. As a result, the ribs would hold the slab of ice until it melted sufficiently, extending the harvest time. However, if the ribs do not extend sufficiently close to the ice forming mold, when the ice contacts the water curtain it will not make it open sufficiently far that the bottom of the slab can clear the bottom edge of the water curtain. If the rib extends outward from the inside surface of the water curtain sufficiently, it may be placed lower on the water curtain so that the moment arm is sufficient for the slab to cause the curtain to swing open and the curtain may still open enough for the slab to clear the bottom edge. Thus as discussed above, the height of the rib 160 and the distances between the pivot axis of the water curtain hinge and the point where the top section 165 of the rib contacts the slab of ice is important, and may require testing on individual ice machines to optimize the rib design and obtain a proper balance of forces.

Figure 5:
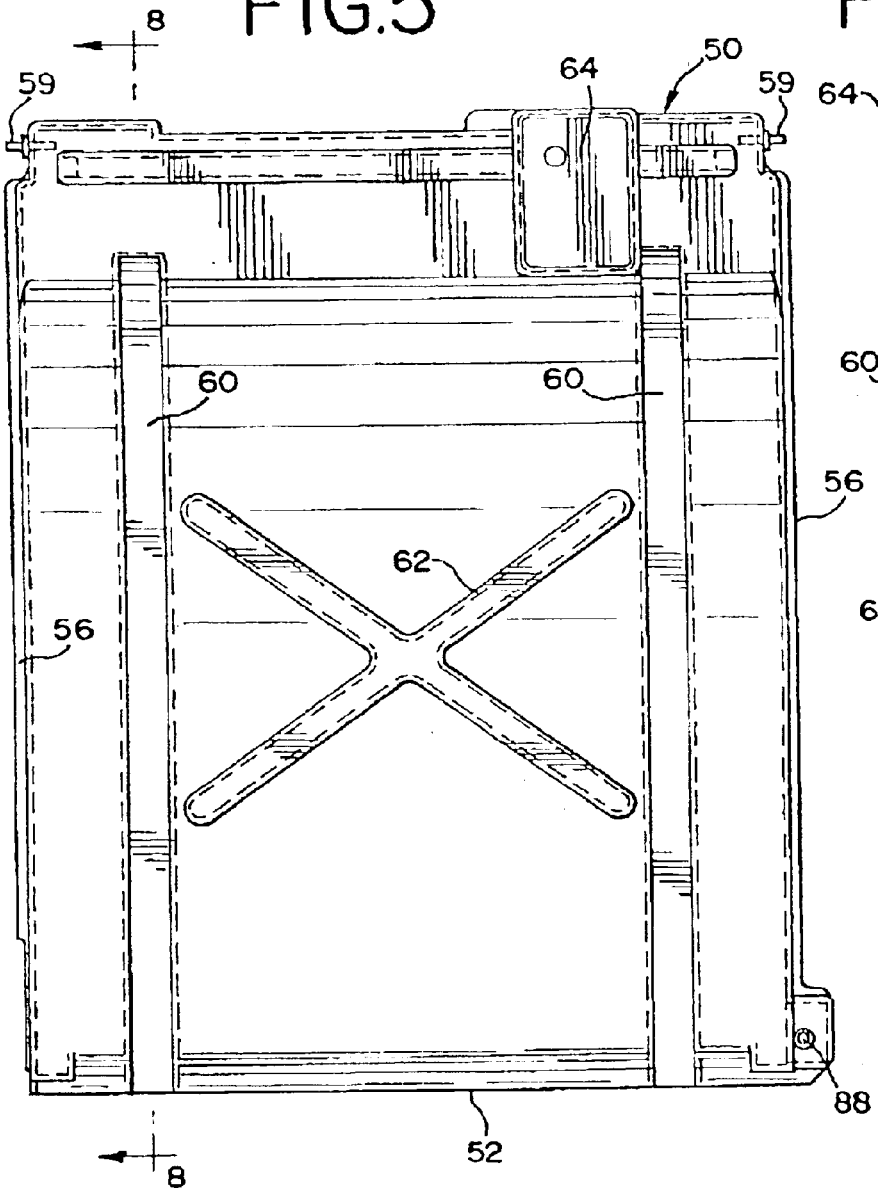
FIG. 5 is a front elevational view of the preferred water curtain used on the ice-making machine of FIG. 1.
Figure 6:
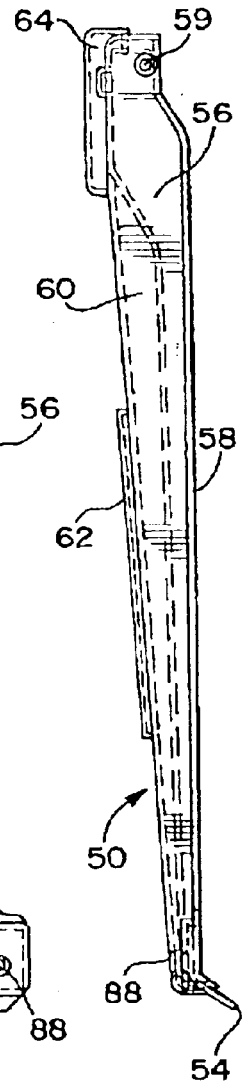
FIG. 6 is a side elevational view of the water curtain of FIG. 5.

The water curtain 150 includes another improvement to aid in the rigidity of the water curtain. Additional structure, in the form of three downwardly pointing chevrons 172, 174 and 176 are molded into the water curtain so as to extend inwardly, the same as ribs 160. The chevrons extend between the ribs 160 so that the ends of the chevrons 172, 174 and 176 tie into the inside wall of the ribs 160, as shown in FIG. 12. By having the additional structure tie into at least one of the side walls of each of the ribs, the ribs 160 (which are large structural elements) are tied together so as to provide rigidity to the water curtain. The figure X 62 of the water curtain of FIG. 5 is on the outside of the water curtain and does not tie into the side walls of the ribs 60. A figure X design could be used as additional structure, instead of the chevrons, but it would need to be on the inside of the water curtain and extend further so that it was tied into the ribs.

Instead of the three chevrons shown, a number of other structures could be molded into the space between the ribs 160. For example, fewer or more chevrons could be used; "W" shapes, curved structures such as half or quarter circles, straight across and lattice structures, and even a snowflake design could be used. Also, rather than two ribs with the additional structure extending between the ribs, other designs could be used. For example, if only one vertical rib were used in the center of the water curtain, one or more chevrons could be added so that their points tied into the ribs. The additional structure could also extend beyond the ribs.

The preferred additional structure has a depth of at least 3/16 inch (0.48 cm). For example, the chevrons 172, 174 and 176 are each about ¼ inch (0.64 cm) deep.

One benefit of the downwardly pointing chevrons is that water flowing down the inside face of the water curtain tends to track towards the center of the water curtain.

It will be appreciated that the addition of some other process steps, materials or components not specifically included will have an adverse impact on the present invention. The best mode of the invention may therefore exclude process steps, materials or components other than those listed above for inclusion or use in the invention. However, the described embodiments are to be considered in all respects only as illustrative and not restrictive. Other changes could be made without detracting from the invention. For example, lateral ribs could also be added to the water curtain just outside the width of the ice-forming mold. These ribs would then guide the slab as it falls so that it would not shift to one side. The scope of the invention is, therefore, indicated by the appended claims rather than by the foregoing description. All changes which come within the meaning and range of equivalency of the claims are to be embraced within their scope.

What is claimed is:

1. In an ice-making machine having a substantially vertical ice-forming mold for freezing cubes of ice, a water distributor for distributing water so as to cascade over a front surface of said ice-forming mold and a hinged water curtain with a bottom edge for directing said cascading water into a sump, the bottom edge of the water curtain extending under the ice-forming mold in a closed position, with the hinge allowing the water curtain to swing out of the way so that a slab of interconnected ice cubes harvested from the mold may fall past the sump and into an ice collecting bin, the improvement comprising:

a) the water curtain having an inside surface adjacent to a front surface of the ice-forming mold configured such that as the slab of ice cubes is released from the mold during a harvest cycle, ice in the slab contacts said inside surface and forces the water curtain to open, before the slab is fully released, to a point where the bottom of the falling slab of ice cubes will not contact the bottom edge of the water curtain.

2. The improved ice-making machine of claim 1 wherein the inside surface of the water curtain has a plurality of vertical ribs that contact the slab of ice cubes.

3. The improved ice-making machine of claim 2 wherein the plurality of ribs comprises two ribs, each wider than an individual cube of ice formed in the ice-forming mold.

4. The improved ice-making machine of claim 2 wherein the ribs extend up to a height below the height of the top of the ice-forming mold, and the top portion of the ribs are tapered downwardly and outwardly from the inside surface of the water curtain.

5. The improved ice-making machine of claim 4 wherein the tapered top section of each of the ribs joins to the rest of the rib with a section having an outer radius of at least 1 inch (2.5 cm).

6. The improved ice-making machine of claim 2 wherein the ribs extend to within about 5/16 (0.8 cm) inch of the slab of ice cubes at a point within the top third of the ice slab when the slab is frozen sufficiently thick to be harvested.

7. The improved ice-making machine of claim 2 wherein the ribs contact the slab of ice cubes at a point which is at least 3 inches (7.6 cm) from an axis about which the water curtain is hinged.

8. The improved ice-making machine of claim 2 wherein the ribs have an apex of at least 1 inch (2.5 cm) above the inside surface of the water curtain surrounding the ribs.

9. A water curtain for an ice-making machine comprising one or more ribs formed on the water curtain so as to contact a slab of ice as it is released from an ice-forming mold, the ribs having a sufficient height so that when the water curtain is in place on an ice-making machine, the slab of ice will contact the ribs to force the water curtain out away from the ice-forming mold so that a bottom edge of the water curtain is not underneath the slab of ice.

10. The water curtain of claim 9 wherein the one or more ribs each extend a maximum distance of at least 1⅛ (2.9 cm) inches away from the inside surface of the water curtain.

11. The water curtain of claim 9 wherein the one or more ribs comprise two vertical ribs.

12. The water curtain of claim 9 wherein the ribs are tapered at their top and extend generally parallel to an edge portion of the water curtain designed to contact a frame holding the ice-forming mold.

13. An ice-making machine comprising:

a) a water system including a pump, a sump, a substantially vertical ice-forming mold having a back surface and an open front surface to form a slab of interconnected ice cubes, a distributor for distributing water pumped from the sump over the front surface of the ice-forming mold, and a water line interconnecting the pump and the distributor;

b) a refrigeration system comprising a compressor, a condenser, an expansion device, an evaporator with refrigerant channels formed in a serpentine shape in thermal contact with the back surface of the ice-forming mold, and interconnecting lines therefore; and c) a water curtain having a bottom edge, the water curtain being positioned adjacent the front surface of the ice-forming mold, and the bottom edge extending under the ice-forming mold when the water curtain is closed, so as to direct water cascading over the open front surface of the ice-forming mold into the sump, the water curtain being hinged so as to swing away from the ice-forming mold during harvest of a slab of interconnected ice cubes from the ice-forming mold, the water curtain having an inside surface configured so as to contact the slab of interconnected ice cubes as it is released from the mold, the position of the hinge and the configuration of the inside surface cooperating so as to cause the bottom edge of the water curtain to swing out to a point, before the slab is fully released, where the bottom of the slab of interconnected ice cubes can pass between the sump and the bottom edge of the water curtain without striking the bottom edge of the water curtain as it falls.

14. The ice-making machine of claim 13 further comprising a control system that controls the operation of the refrigeration system, the control system providing for shut down of the compressor when the water curtain remains in an open position for a set period of time, that set period of time being 10 seconds or greater.

15. The ice-making machine of claim 14 wherein the set period of time is 20 seconds or greater.

16. The ice-making machine of claim 14 wherein the set period of time is about 30 seconds.

17. The ice-making machine of claim 13 wherein the water curtain has a plurality of generally vertical ribs formed on its inside surface to contact the slab of interconnected ice cubes.

18. The ice-making machine of claim 17 wherein the water curtain is hinged to swing about an axis near the top of the water curtain and the ribs contact the ice at a point at least about 3 inches (7.6 cm) below said swing axis.

19. The ice-making machine of claim 13 wherein the refrigeration system comprises two evaporators and the water system comprises two ice-forming molds and there are two water curtains, each configured with vertical ribs on the inside surface.

20. A method of producing and harvesting ice from a cube ice-making machine into an ice collecting bin so as to reduce the chance that the ice-making machine will shut down before the ice bin is full, comprising the steps of:

a) forming cubes of ice from water cascading down over a substantially vertical ice-forming mold having a back surface, an open front surface and lateral and vertical dividers that form individual pockets in which individual cubes are frozen, with an ice bridge formed between cubes of ice and over the dividers on the open front surface of the ice-forming mold to constitute a slab of interconnected ice cubes, with water not being frozen being directed into a water sump by a bottom edge of a water curtain, the water curtain being adjacent the open front surface of the ice-forming mold;

b) halting the flow of water and heating the ice-forming mold in a harvest cycle to release the slab of frozen ice cubes, and c) using the upper portion of the slab of cubes to contact ribs on the inside surface of the water curtain to push the bottom edge of the water curtain away from the water sump enough so that the slab of ice released can fall past the bottom edge of the water curtain without the bottom of the slab contacting the bottom side of the water curtain.

21. The method of claim 20 wherein the lateral dividers slope downwardly so that the slab of ice slides out of the pockets under the influences of gravity.

22. The improved ice-making machine of claim 1 wherein ice in the top half of the slab contacts the inside surface of the water curtain to force the water curtain to said point.

23. The improved ice-making machine of claim 2 wherein the ribs have side walls and an additional structure molded into the water curtain is tied into at least one of the side walls of each of the ribs.

24. The improved ice-making machines of claim 23 wherein the plurality of ribs comprises two ribs and wherein the additional structure comprises at least one downwardly pointing chevron.

25. The improved ice-making machine of claim 24 wherein the additional structure comprises three downwardly pointing chevrons.

26. The water curtain of claim 11 further comprising a structure molded into the water curtain extending between the ribs.

27. The water curtain of claim 26 wherein the additional structure comprises at least one downwardly pointing chevron.

28. The water curtain of claim 26 wherein the additional structure comprises a plurality of downwardly pointing chevrons.

29. The ice-making machine of claim 13 wherein the inside surface of the water curtain is configured so as to contact the upper portion of the slab of interconnected ice cubes as it is released from the mold.

30. The ice-making machine of claim 17 wherein the water curtain further comprises additional structure molded into the water curtain extending between and connected to the ribs to tie the ribs together, thus increasing the rigidity of the water curtain.

31. The ice-making machine of claim 30 wherein the additional structure comprises a plurality of downwardly pointing chevrons.

32. The method of claim 21 wherein the ice slab contacts the ribs at points within the upper ⅔ portion of the ice slab.

33. An improved water curtain for an ice-making machine to be mounted so as to have an inside surface that catches splashes of water flowing over an ice-flowing mold and directs the water into a sump, the improvement comprising a pair of generally vertical ribs on the inside surface of the water curtain and additional structure also on the inside surface extending between and tying the ribs together.

34. The improved water curtain for claim 33 wherein the additional structure comprises at least one downwardly pointing chevrons.

35. In an ice-making machine having a substantially vertical ice-forming mold for freezing cubes of ice, a water distributor for distributing water so as to cascade over a front surface of said ice-forming mold and a hinged water curtain with a bottom edge for directing said cascading water into a sump, with the hinge allowing the water curtain to swing out of the way so that a slab of interconnected ice cubes harvested from the mold may fall past the sump and into an ice collecting bin, the improvement comprising:

a) the water curtain having an inside surface adjacent to a front surface of the ice-forming mold configured such that as the slab of ice cubes is released from the mold during a harvest cycle, ice in the slab contacts said inside surface and forces the water curtain to open to a point where the bottom of the falling slab of ice cubes will not contact the bottom edge of the water curtain, wherein the inside surface of the water curtain has a plurality of vertical ribs that contact the slab of ice cubes.

36. An ice-making machine comprising:

a) a water system including a pump, a sump, a substantially vertical ice-forming mold having a back surface and an open front surface to form a slab of interconnected ice cubes, a distributor for distributing water pumped from the sump over the front surface of the ice-forming mold, and a water line interconnecting the pump and the distributor;

b) a refrigeration system comprising a compressor, a condenser, an expansion device, an evaporator with refrigerant channels formed in a serpentine shape in thermal contact with the back surface of the ice-forming mold, and interconnecting lines therefore;

c) a water curtain having a bottom edge, the water curtain being positioned adjacent the front surface of the ice-forming mold so as to direct water cascading over the open front surface of the ice-forming mold into the sump, the water curtain being hinged so as to swing away from the ice-forming mold during harvest of a slab of interconnected ice cubes from the ice-forming mold, the water curtain having an inside surface configured so as to contact the slab of interconnected ice cubes as it is released from the mold, the position of the hinge and the configuration of the inside surface cooperating so as to cause the bottom edge of the water curtain to swing out to a point where the bottom of the slab of interconnected ice cubes can pass between the sump and the bottom edge of the water curtain without striking the bottom edge of the water curtain as it falls; and d) a control system that controls the operation of the refrigeration system, the control system providing for shut down of the compressor when the water curtain remains in an open position for a set period of time, that set period of time being 10 seconds or greater.

37. An ice-making machine comprising:

a) a water system including a pump, a sump, a substantially vertical ice-forming mold having a back surface and an open front surface to form a slab of interconnected ice cubes, a distributor for distributing water pumped from the sump over the front surface of the ice-forming mold, and a water line interconnecting the pump and the distributor;

b) a refrigeration system comprising a compressor, a condenser, an expansion device, an evaporator with refrigerant channels formed in a serpentine shape in thermal contact with the back surface of the ice-forming mold, and interconnecting lines therefore; and c) a water curtain having a bottom edge, the water curtain being positioned adjacent the front surface of the ice-forming mold so as to direct water cascading over the open front surface of the ice-forming mold into the sump, the water curtain being hinged so as to swing away from the ice-forming mold during harvest of a slab of interconnected ice cubes from the ice-forming mold, the water curtain having an inside surface configured so as to contact the slab of interconnected ice cubes as it is released from the mold, the position of the hinge and the configuration of the inside surface cooperating so as to cause the bottom edge of the water curtain to swing out to a point where the bottom of the slab of interconnected ice cubes can pass between the sump and the bottom edge of the water curtain without striking the bottom edge of the water curtain as it falls, wherein the water curtain has a plurality of generally vertical ribs formed on its inside surface to contact the slab of interconnected ice cubes.

* * * * *